US006944960B2

(12) United States Patent
Co

(10) Patent No.: US 6,944,960 B2
(45) Date of Patent: Sep. 20, 2005

(54) CRAYON SHARPENER

(75) Inventor: Victor Co, Hong Kong (CN)

(73) Assignee: Cosimex (H.K) Limited, Hong Kong (CN)

( * ) Notice: Subject to any disclaimer, the term of this patent is extended or adjusted under 35 U.S.C. 154(b) by 0 days.

(21) Appl. No.: 10/753,018

(22) Filed: Dec. 30, 2003

(65) Prior Publication Data

US 2005/0138819 A1 Jun. 30, 2005

(51) Int. Cl.[7] ..... B43L 23/00
(52) U.S. Cl. ..... 30/454; 30/453
(58) Field of Search ..... 30/451, 452, 453, 30/454, 455, 457, 458, 459, 402; 144/28.11

(56) References Cited

U.S. PATENT DOCUMENTS 1,920,957 A * 8/1933 Cassini ..... 30/454
2,624,316 A * 1/1953 Blanco et al. ..... 30/461
2,691,960 A * 10/1954 Leeds et al. ..... 30/454
4,513,798 A * 4/1985 Luttgens ..... 144/28.11
4,991,299 A * 2/1991 Dietterich et al. ..... 30/453
5,046,876 A * 9/1991 Boraca ..... 401/50
6,301,791 B1 * 10/2001 Luttgens ..... 30/454
6,574,875 B2 * 6/2003 Lawson et al. ..... 30/461

* cited by examiner

*Primary Examiner*—Hwei-Siu Payer

(57) ABSTRACT

The present invention relates to a crayon sharpener, which comprises a cavity to which a crayon is to be inserted, a stopper with a plane at one end, a blade which is fixed at an angle corresponding to the cavity and the stopper, and a connecting shaft which has a hole in it for installing in an electric or hand-operated sharpener. This invention can sharpen crayons smoothly and quickly without easily breaking them and the tips of the crayons will not be too sharp. This invention can be used alone or installed in an electric or hand-operated sharpener as a replaceable part to sharpen crayons and is more convenient and economical to use.

8 Claims, 3 Drawing Sheets

CRAYON SHARPENER

BACKGROUND OF THE INVENTION

The present invention relates to a sharpener and more particularly pertains to a sharpener which is specially designed for sharpening crayons.

Available sharpeners in the marketplace are mostly electric or hand-operated sharpeners tailored for sharpening pencils only. As crayons are generally thicker and more brittle than pencils, ordinary sharpeners fail to sharpen crayons smoothly and satisfactorily. Crayons are easily broken while being sharpened. Even when crayons are sharpened without broken, the tips of which are likely to be too sharp and easily broken while in use. Ordinary sharpeners therefore cannot fit the requirements for sharpening crayons, thus causing inconvenience and wastage.

There are some sharpeners in the marketplace tailor-made for sharpening crayons only but they are usually of designs very different from those of pencil sharpeners. The existing crayon sharpeners are designed to have the apex of their housing forming a predetermined parabolic shape. A smooth curved surface along the writing end of a crayon is created by applying force manually to press the writing end to the apex of the parabolic housing. U.S. Pat. No. 4,991,299 is a typical example of such manual crayon sharpeners. In comparison with the sharpening method by using a blade in a conventional pencil sharpener, the manual method of the existing crayon sharpeners is difficult to use, especially by children, and it is not possible to adjust the curvature of the writing end to suit the different requirements of the crayon users. Further, by pressing the writing end of a crayon to form a smooth curved surface, the texture of the writing end will condense and it affects the coloring results.

BRIEF SUMMARY OF THE INVENTION

In view of the aforesaid disadvantages now present in the prior art, the present invention provides an improved crayon sharpener which can sharpen crayons in accordance with the requirements of the crayon users as an ordinary pencil sharpener.

To attain this, the present invention generally comprises a cavity, a stopper, a blade and a connecting shaft.

The cavity is composed of a cylindrical section and a conical section joining together. The cavity is specially designed for housing a crayon. The diameter of the opening of the cylindrical section of the cavity and the length of the cavity are larger than those of an ordinary pencil sharpener. The overall capacity of the cavity is larger than that of an ordinary pencil sharpener.

The stopper forms one united body with the cavity. One end of the stopper faces the converging tip of the conical section with a distance in between. The stopper can be in any shape with a small plane at its end facing the converging tip of the conical section. The small plane prevents the tip of the sharpened crayon from becoming too sharp.

The blade has a hole on it and the blade is fixed onto the crayon sharpener by securing it with a bolt and a nut. There are two ridges on the crayon sharpener for delineating the exact position for the blade. The blade is specially placed at an angle for sharpening a crayon.

The connecting shaft forms one united body with the cavity at the other end of the stopper not facing the converging tip of the conical section. The connecting shaft is in column shape. At the open end of it, there is a hole. Through the hole, the crayon sharpener can be installed into an electric sharpener or a hand-operated sharpener.

It is an object of the present invention to provide an improved crayon sharpener which can sharpen crayons with their tips not too sharp in accordance with the requirements of the crayon users.

It is another object of the present invention to provide an improved crayon sharpener which can sharpen crayons easily and smoothly without breaking them.

It is a further subject of the present invention to provide an improved crayon sharpener which can be used alone or installed into and removed as a replaceable part from an electric or hand-operated sharpener, thus making it more convenient and economical to sharpen both crayons and pencils.

An even further object of the present invention is to provide an improved crayon sharpener which can serve as a replaceable part for electric or hand-operated sharpeners, thus making them more durable and economical to use.

DETAILED DESCRIPTION OF THE INVENTION

Figure 1:
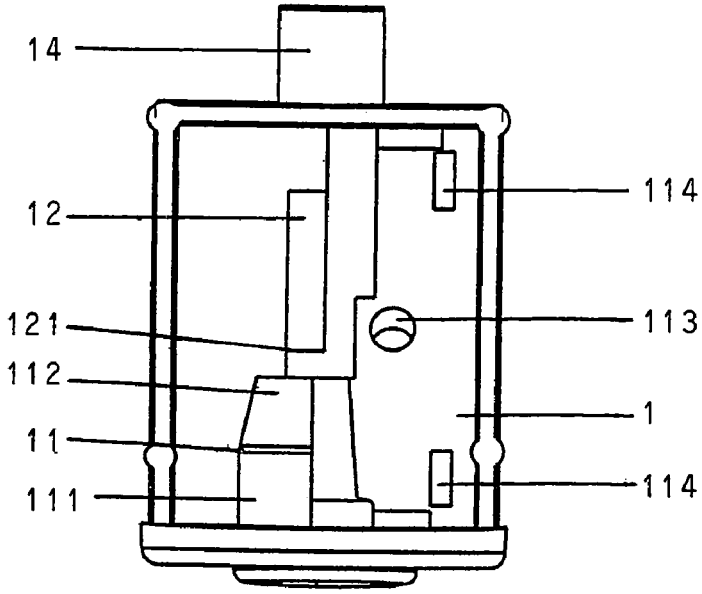
FIG. 1 shows the front view of the present invention with the blade removed.
Figure 2:
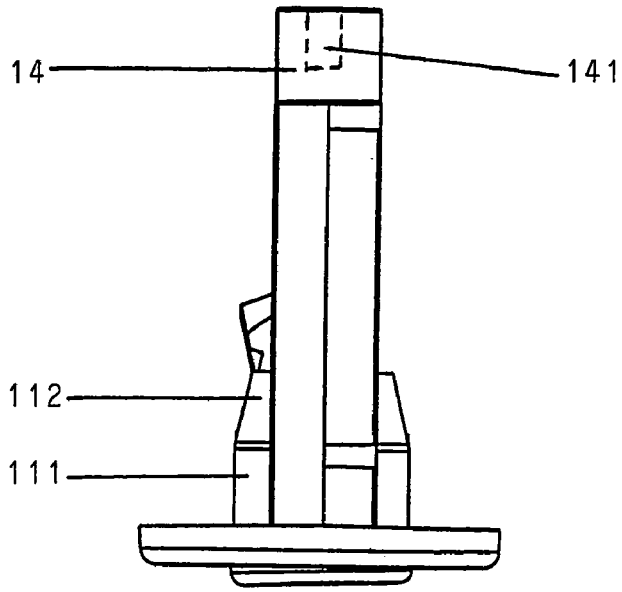
FIG. 2 shows the left side view of the present invention.
Figure 3:
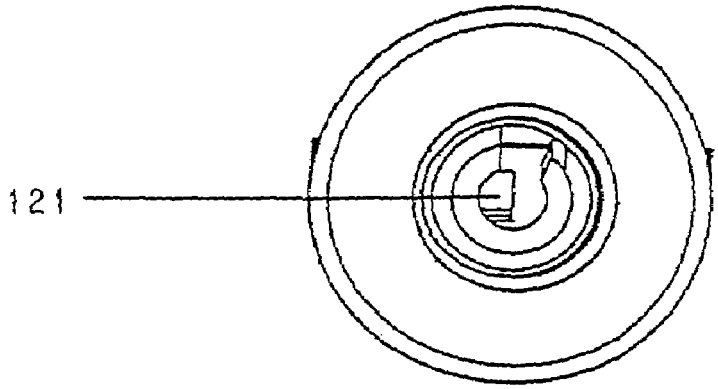
FIG. 3 shows the bottom plan view of the present invention.
Figure 4:
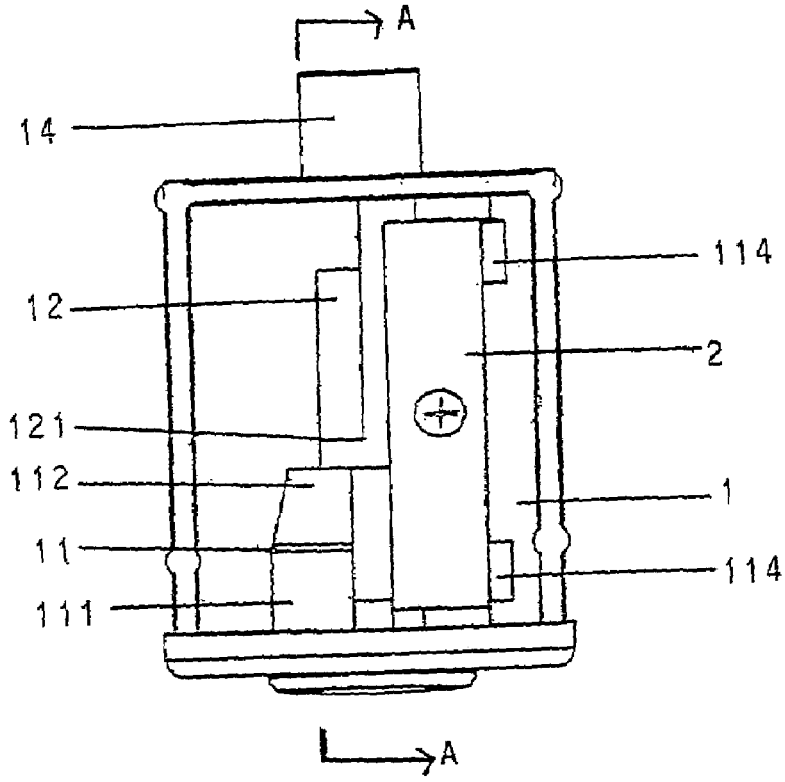
FIG. 4 shows the front view of the present invention with the blade.

As illustrated in FIGS. 1 to 4, the crayon sharpener 1 comprises a cavity 11, a stopper 12, a blade 2 and a connecting shaft 14.

Figure 5:
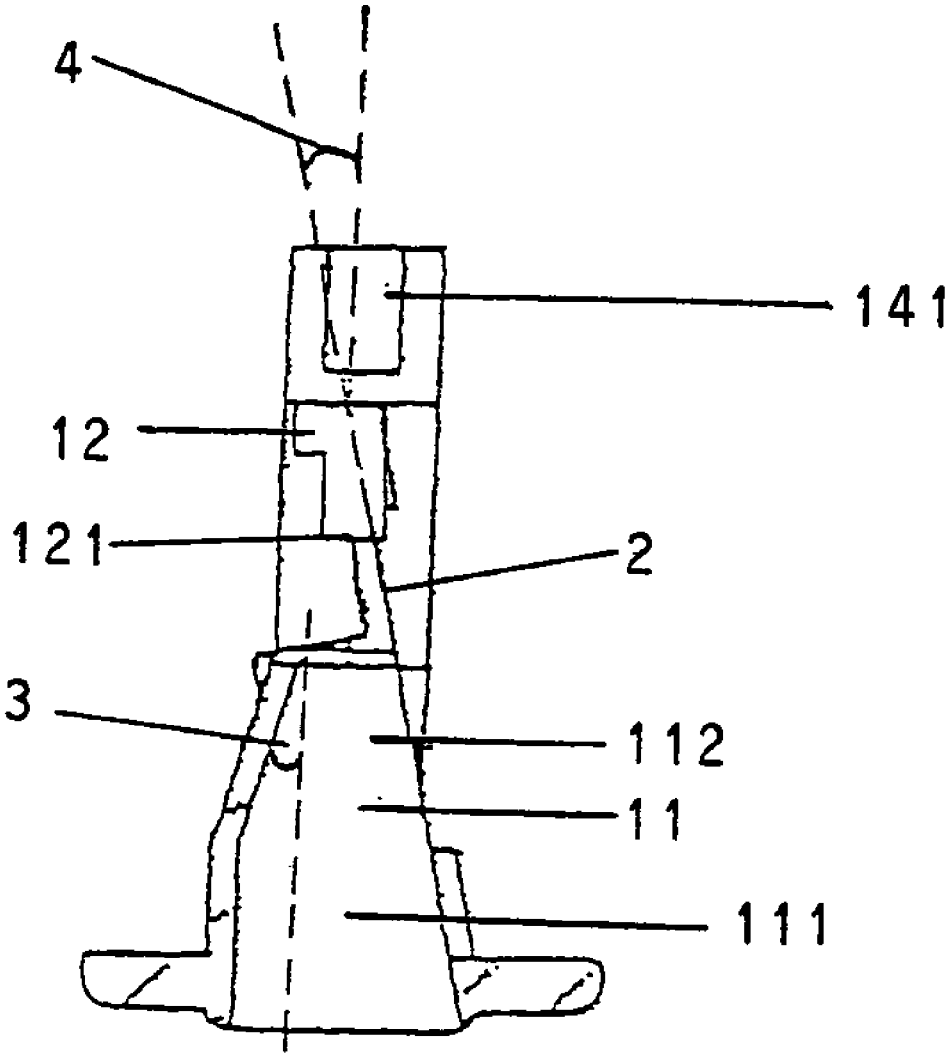
FIG. 5 shows the cross sectional view of the present invention taken along line A—A shown in FIG. 4.

The cavity 11 is composed of a cylindrical section 111 and a conical section 112 joining together. The cavity 11 is specially designed for housing a crayon. The diameter of the opening of the cylindrical section 111 of the cavity 11 is larger than that of an ordinary pencil sharpener. The desired diameter is in the range of 9.0 mm to 12.0 mm. The desired length of the cavity 11 is in the range of 10.0 mm to 15.0 mm with the desired length of the cylindrical section 111 in the range of 5.0 mm to 8.0 mm and that of the conical section 112 in the range of 5.0 mm to 8.0 mm. As illustrated in FIG. 5, the desired angle of inclination 3 of the conical section 112 is 16.1°.

The stopper 12 forms one united body with the cavity 11. One end of the stopper 12 faces the converging tip of the conical section 112 with a desired distance of 1.5 mm to 2.0 mm in between. The stopper 12 can be in any shape with a small plane 121 at its end facing the converging tip of the conical section 112. The small plane 121 prevents the tip of the sharpened crayon from becoming too sharp.

The blade 2 has a hole on it and the blade 2 is fixed onto the crayon sharpener 1 by inserting a bolt or screw through the hole of the blade 2 and a hole 113 in the crayon sharpener 1 and securing it with a nut. There are also two ridges 114 on the crayon sharpener 1 for delineating the exact position for the blade 2. The blade 2 is specially placed at an angle for sharpening a crayon. As illustrated in FIG. 5, the desired angle of inclination 4 of the blade 2 corresponding to the cavity 11 and the stopper 12 is between 10.5° and 10.8°.

The connecting shaft 14 forms one united body with the cavity 11 at the other end of the stopper 12 not facing the converging tip of the conical section 112. The connecting shaft 14 is in column shape. Its desired length is 6.0 mm. At the open end of it, there is a hole 141 of 3.0 mm in depth. Through the hole 141, the crayon sharpener 1 can be installed into an electric sharpener or a hand-operated sharpener.

As the diameter of the opening of the cylindrical section 111 of the cavity 11 is larger than that of an ordinary pencil sharpener and the capacity of the cavity 11 is larger than that of an ordinary pencil sharpener, the crayon sharpener 1 can better fit a crayon which is thicker than a pencil. A crayon can therefore be inserted into the cavity easily and smoothly making it less vulnerable to break. When sharpening, the specific dimensions of the cavity 11, the stopper 12 and the blade 2 can sharpen the crayon easily and smoothly making it less vulnerable to break and preventing its tip from becoming too sharp. The connecting shaft 14 enables the crayon sharpener 1 to be installed into an electric sharpener or a hand-operated sharpener, which makes sharpening easier. Electric sharpeners and hand-operated sharpeners are commonly available for sharpening pencils. By installing the crayon sharpener 1 when in need, the electric or hand-operated sharpener can sharpen crayons. By installing an ordinary sharpener for pencils, the electric or hand-operated sharpener can sharpen pencils. The electric or hand-operated sharpener can then have two applications and become convenient and economical to use.

As the present invention can be removed or reinstalled freely, when the blade 2 becomes blunt, the blade 2 can be replaced or the whole crayon sharpener can be replaced, thus making the electric or hand-operated sharpener as a whole no need to be replaced and making it more durable and economical to use.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A crayon sharpener comprising:

a cavity which is composed of a cylindrical section and a conical section joining together and the diameter of the opening of the cylindrical section is in the range of 9.0 mm to 12.0 mm and the length of the cavity is in the range of 10.0 mm to 15.0 mm with the length of the cylindrical section in the range of 5.0 mm to 8.0 mm and the length of the conical section in the range of 5.0 mm to 8.0 mm;

a stopper which forms one united body with the cavity, with one end of which in plane form facing the converging tip of the conical section with a distance in between;

a blade which is fixed onto the crayon sharpener at an angle corresponding to the cavity and the stopper;

a connecting shaft, which forms one united body with the cavity at the other end of the stopper with a hole in it.

2. A crayon sharpener as in claim 1, wherein through the connecting shaft the crayon sharpener can be installed into and removed from an electric sharpener or a hand-operated sharpener as a replaceable part.

3. A crayon sharpener as in claim 1, wherein the angle of inclination of the conical section is 16.1°.

4. A crayon sharpener as in claim 1, wherein the distance between the converging tip of the conical section and the end of the stopper facing thereto is in the range of 1.5 mm to 2.0 mm.

5. A crayon sharpener as in claim 1, wherein the angle of inclination of the blade corresponding to the cavity and the stopper is between 10.5° and 10.8°.

6. A crayon sharpener as in claim 1 or 5, wherein two ridges are placed on the crayon sharpener for positioning the blade.

7. A crayon sharpener as in claim 1, wherein the connecting shaft is in column shape.

8. A crayon sharpener as in claim 1 or 7, wherein the length of the connecting shaft is 6.0 mm and the depth of the hole in it is 3.0 mm.

* * * * *